US011091904B2

(12) United States Patent
Kessler et al.

(10) Patent No.: US 11,091,904 B2
(45) Date of Patent: Aug. 17, 2021

(54) SENSOR DEVICE THAT CAN BE ARRANGED IN OR ON A TOILET BOWL

(71) Applicant: Henkel AG & Co. KGaA, Duesseldorf (DE)

(72) Inventors: Arnd Kessler, Monheim am Rhein (DE); Tatiana Schymitzek, Krefeld (DE); Lars Zuechner, Langenfeld (DE); Alexander Mueller, Monheim (DE); Georg Wawer, Vienna (AT); Nadine Goetz, Duesseldorf (DE); Rudolf Lessmann, Singapore (SG)

(73) Assignee: Henkel AG & Co. KGaA, Duesseldorf (DE)

( * ) Notice: Subject to any disclaimer, the term of this patent is extended or adjusted under 35 U.S.C. 154(b) by 55 days.

(21) Appl. No.: 16/470,496

(22) PCT Filed: Dec. 12, 2017

(86) PCT No.: PCT/EP2017/082437
§ 371 (c)(1),
(2) Date: Jun. 17, 2019

(87) PCT Pub. No.: WO2018/114482
PCT Pub. Date: Jun. 28, 2018

(65) Prior Publication Data

US 2020/0123754 A1 Apr. 23, 2020

(30) Foreign Application Priority Data

Dec. 21, 2016 (DE) ..... 10 2016 225 842.7

(51) Int. Cl.
*E03D 9/00* (2006.01)
*E03D 5/10* (2006.01)
(Continued)

(52) U.S. Cl.
CPC ..... *E03D 9/002* (2013.01); *E03D 5/105* (2013.01); *E03D 9/005* (2013.01); *E03D 9/032* (2013.01); *E03D 9/08* (2013.01)

(58) Field of Classification Search
CPC ..... E03D 9/002; E03D 9/005; E03D 9/032; E03D 9/08; E03D 5/105
(Continued)

(56) References Cited

U.S. PATENT DOCUMENTS 8,987,182 B2 3/2015 Warkotsch et al.
9,260,849 B2 2/2016 Frey et al.
(Continued)

FOREIGN PATENT DOCUMENTS

DE 102006026800 A1 12/2007
DE 102010003810 A1 10/2011
(Continued)

OTHER PUBLICATIONS

EPO, International Search Report and Written Opinion issued in International Application No. PCT/EP2017/082437, dated Mar. 23, 2018.

*Primary Examiner* — Huyen D Le
(74) *Attorney, Agent, or Firm* — Lorenz & Kopf, LLP

(57) ABSTRACT

The present disclosure relates to a method carried out by a sensor device arranged in and/or on a toilet bowl. The method includes the steps of detecting, by a sensor of the sensor device, at least one first environmental parameter in an environment of the sensor device with the first environmental parameter being characteristic of a cleanliness of the toilet bowl, and determining and/or effecting the determination of an item of control information by the sensor device at least partly depending on the detected first environmental parameter.

16 Claims, 4 Drawing Sheets

(51) Int. Cl.
*E03D 9/03* (2006.01)
*E03D 9/08* (2006.01)

(58) Field of Classification Search
USPC ..... 4/662
See application file for complete search history.

(56) References Cited

U.S. PATENT DOCUMENTS

| | | | | |
|---|---|---|---|---|
| 2006/0021121 | A1 | 2/2006 | Moussa | |
| 2007/0136937 | A1* | 6/2007 | Sawalski | B65D 83/759 4/223 |
| 2009/0194562 | A1 | 8/2009 | Kessler et al. | |
| 2010/0071121 | A1* | 3/2010 | Kissner | E03D 9/032 4/223 |
| 2010/0205729 | A1* | 8/2010 | Muhlhausen | E03D 9/032 4/223 |
| 2010/0205731 | A1* | 8/2010 | Muhlhausen | E03D 9/005 4/223 |
| 2011/0302705 | A1* | 12/2011 | Frey | E03D 9/005 4/223 |
| 2014/0246052 | A1 | 9/2014 | Qualls et al. | |
| 2017/0089053 | A1* | 3/2017 | Doyle | E03D 9/005 |
| 2019/0177960 | A1* | 6/2019 | Sonovani | E03D 9/02 |

FOREIGN PATENT DOCUMENTS

| | | | |
|---|---|---|---|
| EP | 1378612 | A1 | 1/2004 |
| EP | 2138640 | A1 | 12/2009 |
| WO | 0173228 | A1 | 10/2001 |
| WO | 2010130645 | A1 | 11/2010 |
| WO | 2016073651 | A1 | 5/2016 |
| WO | 2016100886 | A1 | 6/2016 |

* cited by examiner

SENSOR DEVICE THAT CAN BE ARRANGED IN OR ON A TOILET BOWL

CROSS-REFERENCE TO RELATED APPLICATIONS

This application is a U.S. National-Stage entry under 35 U.S.C. § 371 based on International Application No. PCT/EP2017/082437, filed Dec. 12, 2017, which was published under PCT Article 21(2) and which claims priority to German Application No. 10 2016 225 842.7, filed Dec. 21, 2016, which are all hereby incorporated in their entirety by reference.

TECHNICAL FIELD

The present disclosure relates, among other things, to a sensor device arrangeable in and/or on a toilet bowl and/or a method executed by a sensor device arranged in and/or on a toilet bowl.

BACKGROUND

The cleanliness of a toilet bowl is often not or hardly noticeable for a user of a toilet. This can lead to problems, for example, when a user does not perceive soiling and the toilet bowl is thus not or not properly cleaned. Also, public toilets must often comply with hygiene regulations and/or cleaning regulations. However, monitoring compliance with these regulations is often problematic since it involves a high workforce burden.

SUMMARY

An object of the present disclosure is therefore to overcome these problems.

According to a first aspect of the present disclosure, a method is disclosed which is executed by a sensor device (for example, a sensor device according to the first aspect of the present disclosure) arranged in and/or on a toilet bowl, the method comprising:

detecting, by a sensor of the sensor device, at least a first environmental parameter in the environment of the sensor device, wherein the first environmental parameter is characteristic of a cleanliness of the toilet bowl; and determining and/or effecting the determination of a control information item by the sensor device at least partially as a function of the detected first environmental parameter.

Furthermore, according to the first aspect of the present disclosure, a sensor device is disclosed, set up for executing and/or controlling the steps of the method according to the first aspect of the present disclosure or comprising respective features for executing and/or controlling the steps of the method according to the first aspect of the present disclosure. In this case, either all steps of the method according to the first aspect of the present disclosure can be controlled by the features, or all steps of the method according to the first aspect of the present disclosure can be executed by the features, or one or more steps are controlled by the features and one or more steps are executed by the features. Different steps can optionally be executed or controlled by different features.

The features of the sensor device according to the first aspect of the present disclosure can comprise hardware and/or software components. The features can, for example, comprise at least one memory with program instructions of a computer program (for example, a computer program according to the first aspect of the present disclosure) and at least one processor configured to execute program instructions from the at least one memory. Accordingly, according to the first aspect of the present disclosure, a sensor device as disclosed is also to be understood as comprising at least one processor and at least one memory with program instructions, wherein the at least one memory and the program instructions are set up, together with the at least one processor, to cause the sensor device to execute and/or control the method according to the first aspect of the present disclosure.

A processor is to be understood in this specification to include control units, microprocessors, microcontroller units such as microcontrollers, digital signal processors (DSP), application specific integrated circuits (ASICs) or field programmable gate arrays (FPGAs).

Examples of memory in the context of this specification are volatile or non-volatile memories, for example, random access memory (RAM) such as NOR flash memory or sequential access such as NAND flash memory and/or memory with read-only access (ROM) or read-write access.

The features of the sensor device according to the first aspect of the present disclosure comprise a sensor. The sensor is set up, for example, to detect an environmental parameter in the environment of the sensor device. In this case, the environment of the sensor device should be understood as meaning, for example, a region detectable by the sensor in the environment of the sensor device.

Alternatively or additionally, the features of the sensor device according to the first aspect of the present disclosure can further comprise one or more communication interfaces and/or user interfaces.

Among other things, a communication interface in this specification is to be understood as setting up a wireless communication interface for communicating (for example, for sending and/or receiving information items) in accordance with a wireless communication technology and/or a wired communication interface for communicating (for example, for sending and/or receiving information items) in accordance with a wired communication technology. For example, a communication interface is a network adapter according to such a communication technology.

An example of a wireless communication technology is a local radio network technology such as Radio Frequency Identification (RFID) and/or Near Field Communication (NFC) and/or Bluetooth (for example, Bluetooth Version 2.1 and/or 4.0) and/or Wireless Local Area Network (WLAN). For example, RFID and NFC are specified in accordance with ISO standards 18000, 11784/11785 and ISO/IEC standards 14443-A and 15693. The Bluetooth specifications are currently available on the Internet at www.bluetooth.org. For example, WLAN is specified in the standards of the IEEE 802.11 family. A further example of a wireless communication technology is a supra-local radio network technology, such as a mobile radio technology, for example, Global System for Mobile Communications (GSM) and/or Universal Mobile Telecommunications System (UMTS) and/or Long Term Evolution (LTE). The GSM, UMTS and LTE specifications are maintained and developed by the 3rd Generation Partnership Project (3GPP) and are currently available on the Internet at www.3gpp.com, among others.

An example of a wired communication technology is Ethernet and/or Local Area Network (LAN). Ethernet and/or LAN are specified, for example, in the standards of the IEEE 802.3 family.

A user interface in the context of this specification is, for example, set up for detecting a user input (for example, an input of a user) and/or for outputting a user information item (for example, a user information item for a user). Examples of such a user interface are one or more keys, a keyboard (for example, an alphanumeric keyboard or a numeric keypad such as a keypad), a mouse, a screen (for example, a touch-sensitive screen such as a touch display), a microphone, a camera, and or a signal lamp (for example, a light-emitting diode and/or a light bulb and/or a glow lamp) and/or a signal lamp arrangement having a plurality of signal lamps.

It is understood that the sensor device according to the first aspect of the present disclosure can also comprise other features not mentioned.

Furthermore, according to the first aspect of the present disclosure, there is disclosed a computer program comprising program instructions configured to cause a device (for example, the sensor device according to the first aspect of the present disclosure) to execute and/or control the method according to the first aspect of the present disclosure when the computer program is executed by a processor of the device (for example, the sensor device according to the first aspect of the present disclosure).

Furthermore, according to the first aspect of the present disclosure, there is disclosed a computer-readable storage medium containing a computer program according to the first aspect of the present disclosure. A computer-readable storage medium can be configured, for example, as a magnetic, electrical, electro-magnetic, optical and/or different type of storage medium. Such a computer-readable storage medium is preferably representational (that is, "touchable"), for example, it is configured as a data carrier device. Such a data carrier device includes, for example, one of the above-disclosed memories. For example, computer readable should be understood as meaning that the storage medium can be read from and/or written to by a computer or device, such as a processor of the computer and/or the device.

In the following, the features and characteristics of the first aspect of the present disclosure are described, partly by way of example.

The method according to the first aspect of the present disclosure is executed, for example, by a sensor device arranged reversibly in and/or on the toilet bowl. In this case, a device is to be understood as being arranged reversibly in and/or on the toilet bowl when it is not part of the toilet bowl and/or can be removed from the toilet bowl in a non-destructive manner (for example, tool-free). For example, the sensor device is set up for reversible arrangement on and/or in a toilet bowl. It is understood that the sensor device can alternatively or additionally also be part of a device (for example, the dispensing device disclosed below), which is set up for reversible arrangement on and/or in a toilet bowl.

For example, the sensor device is arranged on and/or in the toilet bowl such that the region detectable by the sensor of the sensor device is located in the interior of the toilet bowl.

The toilet bowl is part of a toilet, for example. In this case, the interior of the toilet bowl is understood as meaning the region which surrounds a drain of the toilet and/or on which the flushing liquid flows along at least partially during a flushing of the toilet.

Detecting at least one first environmental parameter in the environment of the sensor device is to be understood, for example, as meaning that the first environmental parameter is detected by the sensor of the sensor device. For example, the region detectable by the sensor of the sensor device is a part of the environment of the sensor device and/or defines the environment of the sensor device in the context of this specification.

For example, the first environmental parameter is indicative of a value of a variable detectable by the sensor (for example, a physical, chemical, and/or biological variable) and/or a property detectable by the sensor (for example, a physical, chemical, and/or biological property). In this case, the detection is to be understood as meaning, for example, determining the respective property and/or measuring a value of the respective variable.

The cleanliness of the toilet bowl, for example, is to be understood as meaning a subjective cleanliness perceived by a user of the toilet bowl. A subjective cleanliness is given, for example, when specified properties perceivable by the user (that is, for properties relevant to subjective cleanliness) such as visible soiling and/or unpleasant odors are not present. Accordingly, the first environmental parameter is, for example, indicative of whether such a property perceptible to the user in the environment of the sensor device can be detected (for example, determined) by the sensor of the sensor device.

Alternatively or additionally, the cleanliness of the toilet bowl, for example, can be understood as meaning an objective cleanliness. Such an objective cleanliness is given, for example, when one or more values of one or more variables do not exceed and/or fall below specified threshold values (that is, threshold values relevant to objective cleanliness). For example, the first environmental parameter is indicative of a value of such a variable that can be detected (for example, measurable) by the sensor.

For example, the first environmental parameter indicates whether the toilet bowl (objectively and/or subjectively) is clean. For example, it can be specified that the first environmental parameter can indicate that the toilet bowl is clean, when the first environmental parameter is indicative of the presence of a property relevant to the subjective cleanliness, and/or when the first environmental parameter is indicative of a value of a variable that does not exceed or fall below a threshold value relevant for the objective cleanliness specified for this variable.

Determining the control information item at least partially as a function of the detected first environmental parameter is to be understood as meaning, for example, that the control information item is selected and/or calculated at least partially as a function of the detected first environmental parameter.

It is understood that, in addition to the first environmental parameter, one or more further environmental parameters can be detected. In this case, the control information item can be determined, for example, at least partially as a function of the first environmental parameter and the further environmental parameters.

The determination can be performed, for example, according to specified determination rules (for example, selection and/or calculation rules). For example, the determination rules assign control information items of a plurality of control information items to the first environment parameter (and the further environment parameters). For example, the determination rules can specify that, when the first environmental parameter (and/or one of the further environmental parameters) indicates that the toilet bowl is clean, a first control information item of the plurality of control information items is determined (for example, selected). Otherwise, for example, a second control information item of the plurality of control information items is determined (for example, selected).

The control information item is set up, for example, to trigger and/or control an action that can be executed by the sensor device and/or by a device other than the sensor device (for example, outputting a user information item and/or outputting an active ingredient preparation). For example, the control information item is a control signal that triggers and/or controls such an action.

For example, the control information item is determined by the sensor device. Alternatively or additionally, the control information item can also be determined by a device other than the sensor device. Effecting the determination of the control information item is to be accordingly understood, for example, that the sensor device effects the control information item being determined by a device other than the sensor device. For example, the first environmental parameter is sent by the sensor device to the device other than the sensor device to effect the determination of the output control information item by the sensor device.

Determining the control information item at least partially as a function of the detected first environmental parameter therefore makes it possible to trigger an action, in particular a cleaning action, when the toilet is dirty, regardless of whether the soiling was perceived by a user and/or is even perceptible to a user.

Further features and characteristics of the first aspect of the present disclosure are explained below on the basis of exemplary embodiments according to the first aspect of the present disclosure.

According to an exemplary embodiment of the first aspect of the present disclosure, the at least one sensor is an optical sensor.

An example of an optical sensor is a camera, a charge coupled device (CCD) sensor, an active pixel sensor, a reflection sensor, a turbidity sensor.

For example, the first environmental parameter detected by the optical sensor is indicative of:

a surface roughness and/or a change in a surface roughness of a surface of the toilet bowl, a wettability and/or a change in a wettability of a surface of the toilet bowl, an optical reflection and/or a change in an optical reflection on a surface of the toilet bowl, and/or a turbidity of a liquid located in the toilet bowl.

The surface roughness of the surface in the interior of the toilet bowl continues to increase over time after a cleaning process due to dirt and lime deposits on the surface in the interior of the toilet bowl, so that the surface roughness of the surface in the interior of the toilet bowl is an environmental parameter characteristic of the cleanliness of the toilet bowl. The surface roughness of the surface of the toilet bowl and/or the change in the surface roughness of the surface of the toilet bowl can be determined as a function of the optical reflection and/or the change in the optical reflection on the surface of the toilet bowl. In particular, a change in the surface roughness of the surface of the toilet bowl leads to a change in the optical reflection on the surface of the toilet bowl.

Furthermore, the wettability of the surface in the interior of the toilet bowl changes after a cleaning process over time due to the increasing dirt and limescale deposits. This change is evident, for example, from a change in the wetting time of the surface in the interior of the toilet bowl after a flushing of the toilet. Since the wetting of the surface in the interior of the toilet bowl also leads to a change in the optical reflection on the surface of the toilet bowl, the wettability and/or a change in the wettability are determined as a function of the optical reflection and/or the change in the optical reflection and/or the change in the optical reflection on the surface of the toilet bowl (for example, after flushing the toilet), for example, a change in the wetting time (for example, after flushing the toilet) can be determined through this.

An environmental parameter indicative of an optical reflection and/or a change in the optical reflection can be detected, for example, by a reflection sensor. For example, an environmental parameter indicative of the optical reflection and/or a change in the optical reflection on the surface of the toilet bowl is a value for the intensity and/or a change in the intensity of a light reflected from the surface of the toilet bowl in the direction of a reflection sensor (for example, a light generated by the reflection sensor). For example, the reflection sensor is set up to detect (for example, to detect after flushing the toilet) a value for the intensity and/or a change in intensity of a light (for example, a light generated by the reflection sensor) reflected from the surface of the toilet bowl in the direction of a reflection sensor. Such a value for the intensity of a reflected light from the surface of the toilet bowl in the direction of a reflection sensor (for example, a light generated by the reflection sensor) and/or a change in the intensity of a light reflected from the surface of the toilet bowl in the direction of a reflection sensor (for example, a light generated by the reflection sensor) is to be understood, for example, as an environmental parameter characteristic of soiling and/or calcification of the surface of the toilet bowl (and thus for the cleanliness of the toilet bowl). For example, a threshold value for the intensity of a light reflected from the surface of the toilet bowl in the direction of a reflection sensor can be specified. For example, when the first environmental parameter is indicative of an intensity of light reflected from the surface of the toilet bowl in the direction of the reflection sensor that does not fall below this threshold, it is specified that the toilet bowl is clean. Otherwise, for example, it is specified that the toilet bowl is not clean.

Alternatively or additionally, a threshold value for a change in the intensity of a light reflected from the surface of the toilet bowl in the direction of a reflection sensor (for example, a light generated by the reflection sensor) can be specified. For example, when the first environmental parameter is indicative of an intensity of light reflected from the surface of the toilet bowl in the direction of the reflection sensor that does not exceed this threshold, it is specified that the toilet bowl is clean. Otherwise, for example, it is specified that the toilet bowl is not clean.

An environmental parameter indicative of a turbidity of a liquid located in the toilet bowl can be detected, for example, by a turbidity sensor. An example of such an environmental parameter is a turbidity value of the liquid. For example, the turbidity sensor is set up to detect a turbidity value of a liquid located in the toilet bowl. Such a turbidity value is to be understood, for example, as an environmental parameter characteristic of soiling of the liquid located in the toilet bowl (and thus for the cleanliness of the toilet bowl). For example, a threshold can be specified for a turbidity value of a liquid located in the toilet bowl. For example, when the first environmental parameter is indicative of a turbidity value of a liquid located in the toilet bowl that does not fall below this threshold, it is specified that the toilet bowl is clean. Otherwise, for example, it is specified that the toilet bowl is not clean.

Examples of variables that describe a turbidity of a liquid are the units FTU (Formazine Turbidity Unit) and NTU (Nephelometric Turbidity Unit), both of which are used in water treatment.

According to an exemplary embodiment of the first aspect of the present disclosure, the at least one sensor is a biosensor.

For example, the first environmental parameter detected by the biosensor is indicative of:

a bacterial content on the surface of the toilet bowl, and/or a bacterial content of a liquid located in the toilet bowl.

For example, the biosensor is set up to detect the exceeding of a bacterial count on the biosensor (for example, a number of bacteria adhered to the biosensor). When the biosensor is arranged on the surface of the toilet bowl (and, for example, above a liquid located in the toilet bowl), such an exceeding of a bacterial count on the biosensor detected by the biosensor (for example, increased and/or undesirable) is to be understood as an environmental parameter characteristic of a bacterial content (and thus for the cleanliness of the toilet bowl) on the surface of the toilet bowl. Accordingly, such an exceeding of a bacterial count on the biosensor detected by the biosensor is to be understood as an environmental parameter characteristic of a (for example, increased and/or undesired) bacterial content of a liquid located in the toilet bowl (and thus of the cleanliness of the toilet bowl) when the biosensor is arranged in the liquid located in the toilet bowl. For example, it is specified that the toilet bowl is clean as long as the biosensor does not detect an exceeding of a bacterial count on the biosensor. Otherwise, for example, it is specified that the toilet bowl is not clean.

According to an exemplary embodiment of the first aspect of the present disclosure, the at least one sensor is an optical sensor, a biosensor, an acoustic sensor, a chemical sensor, a thermal sensor and/or a weight sensor. It is understood that the sensor device according to the first aspect of the present disclosure can also comprise a plurality of these sensors.

According to an exemplary embodiment of the first aspect of the present disclosure, the method further comprises the following:

outputting and/or effecting the outputting of a user information item, wherein the user information item is at least partially a function of the control information item.

For example, the outputting of the user information item is triggered by the control information item.

For example, the output user information item indicates to a user whether the toilet bowl is clean.

For example, the determination rules specified above can specify that, when the first environmental parameter (and/or one of the further environmental parameters) indicates that the toilet bowl is clean, a first control information item of the plurality of control information items is determined (for example, selected), which first control information item triggers the outputting of a first user information item that indicates to a user that the toilet bowl is clean. Otherwise, the determination rules disclosed above, for example, specify that a second control information item of the plurality of control information items is determined (for example, selected), which second control information item triggers the outputting of a second user information item that indicates to a user that the toilet bowl is not clean.

Alternatively or additionally, the second user information item can indicate to the user that the toilet bowl should be cleaned and/or give the user a cleaning recommendation to clean the toilet bowl. In this case, such a cleaning recommendation, for example, can contain an indication for an active ingredient preparation (for example, a cleaning agent) for cleaning the toilet bowl. The cleaning recommendation can be at least partially a function of the first detected environmental parameter. For example, the control information item is determined such that when the first environmental parameter (and/or one of the further environmental parameters) indicates that the toilet bowl is not clean, it triggers and/or controls the outputting of the second user information item with a cleaning recommendation at least partially as a function of the detected first environmental parameter.

For example, the second user information item can have different cleaning recommendations when the first detected environmental parameter is characteristic of soiling and/or calcification of the surface of the toilet bowl, or when the detected first environmental parameter is characteristic of (for example, increased and/or undesired) bacterial content on the surface of the toilet bowl. For example, in the case of soiling or calcification of the surface of the toilet bowl, a lime-dissolving active ingredient preparation is recommended for cleaning the toilet bowl, and in case of (for example, increased) bacterial content on the surface of the toilet bowl, an antibacterial active ingredient preparation is recommended for cleaning the toilet bowl.

This is advantageous, for example, to enable a soiling-dependent cleaning of the toilet bowl by the user—even when there is no soiling (for example, by an increased bacterial content) of the toilet bowl perceivable by the user.

The outputting of the user information item can be done for example, by a user interface.

For example, the user information item is output by a user interface of the sensor device, for example, an optical user interface, in particular a display. In this case, a display is to be understood as meaning, for example, a signal lamp and/or a signal lamp arrangement having a plurality of signal lamps. Accordingly, the user could be notified, for example, by a signal lamp (for example, by a multi-colored signal lamp) and/or by a signal lamp arrangement (for example, by a signal lamp arrangement having different colored signal lamps), whether the toilet bowl is clean. Furthermore, a display is also to be understood as meaning a screen, so that the user can be notified on the screen by outputting an appropriate user information item (for example, in text form) as to whether the toilet bowl is clean.

Alternatively or additionally, the outputting of the user information item can be effected by a user interface of a device other than the sensor device (for example, the device according to the second aspect of the present disclosure). Accordingly, effecting the outputting of the user information item is to be understood, for example, as meaning that the sensor device effects the user information item to be output from a device other than the sensor device. For example, the control information item is sent and/or provided by a wireless communication interface of the sensor device to effect the outputting of the user information item.

The sending of the control information item can take place, for example, in the form of a broadcast signal (for example, a beacon signal such as a Bluetooth beacon signal). Accordingly, the wireless communication interface of the sensor device can be a Bluetooth interface. This is advantageous, for example, in order to send the control information item to all devices which are in the reception range of the sent broadcast signal.

Providing the control information item by a wireless communication interface is to be understood, for example, as meaning that the control information item is held ready by a passive wireless communication interface for reading by a corresponding active wireless communication interface. Passive wireless communication interfaces, when read by a corresponding active wireless communication interface, are supplied with energy by the corresponding active wireless communication interface. For example, when reading, the corresponding active wireless communication interface generates an electrical, magnetic and/or electro-magnetic field to supply energy to the passive wireless communication interface. Examples of such passive wireless communication interfaces are passive electronic transceivers such as passive RFID interfaces (for example, passive RFID tags) and/or passive NFC interfaces (for example, passive NFC tags). This is advantageous, for example, in order to keep the energy consumption of the sensor device as low as possible.

According to an exemplary embodiment of the first aspect of the present disclosure, the sensor device is part of a dispensing device. The dispensing device is, for example, set up for reversible arrangement on and/or in a toilet bowl.

Furthermore, the dispensing device is set up, for example, to receive and/or hold an active ingredient preparation. In addition, the dispensing device can be set up to dispense and/or output a received and/or held active ingredient preparation.

For example, the dispensing device comprises a bow-shaped holding element that is fixable to an edge of a toilet bowl and, when the holding element is fixed to the edge of the toilet bowl, distal end located in the interior of the toilet bowl, wherein the sensor device is arranged at the distal end. Furthermore, an active ingredient preparation received and/or held by the dispensing device is also located, for example, at this distal end. The limited space in the interior of the toilet bowl can be used very efficiently by combining the sensor device with such a dispensing device. This is because often this limited space allows only the reversible arrangement (for example, fixing) of a device, without negatively influencing the flow behavior of the flushing liquid during flushing and thus impairing the flushing function.

The active ingredient preparation can be present, for example, in solid form as a toilet block (for example, as a spherical toilet block as described in international patent publication WO 2010/130645) and can be received and/or held by the dispensing device. For example, the dispensing device (for example, at the distal end at which the sensor device is arranged) comprises one or more open disks with holding features for holding one or more such toilet blocks and/or one or more open receptacles for receiving one or more such toilet blocks. When the dispensing device is arranged on and/or in a toilet bowl, the toilet blocks can come into contact with the flushing liquid in a flushing and ingredients of the toilet blocks are dissolved by the flushing liquid, so that they are discharged from the dispensing device into the flushing liquid and can take effect there when flushing the toilet bowl (for example, a cleaning and/or lime-dissolving and/or fragrant and/or disinfecting and/or antibacterial effect).

Alternatively or additionally, the method according to the first aspect of the present disclosure can also comprise outputting and/or effecting the outputting of the active ingredient preparation by the dispensing device at least partially as a function of the control information item.

In this case, the active ingredient preparation is present, for example, in liquid and/or gelatinous form and is, for example, located in a (for example, closed) container which can be connected to the dispensing device for receiving the active compound preparation. For example, the dispensing device comprises the container for receiving the active ingredient preparation and at least one actuator, wherein the control information item is set up to trigger and/or to control a movement of the actuator. For example, the control information item can be a control signal for driving the actuator. For example, the movement of the actuator effects the dispensing of the active ingredient preparation.

An example of such an actuator is a pump (for example, a positive displacement pump, oscillatory pump, diaphragm pump, piston pump, rotary pumps, dynamic pump, centrifugal pump, electrohydrodynamic pump, electroosmotic pump, magnetohydrodynamic pump, surface acoustic wave pump, capillary force pump, electrowetting pump and/or thermocapillary pump), a nozzle, a spray head, a drop dispensing device, a foam spray head, a piezo element, a wick system and/or a nebulizer (for example, an ultrasonic nebulizer and/or an ionizing nebulizer)

The active ingredient preparation comprises at least one perfume and a nonionic surfactant.

Substances which also serve as ingredients of cosmetic products are referred to below, where possible, according to the International Nomenclature Cosmetic Ingredient (INCI) nomenclature. Chemical compounds carry an INCI name in English, plant ingredients are listed only according to Linne in Latin, so-called trivial names such as "water", "honey" or "sea salt" are also given in Latin. The INCI names can be found in the International Cosmetic Ingredient Dictionary and Handbook—Seventh Edition (1997), The Cosmetic, Toiletry, and Fragrance Association (CTFA), 1001 17th Street, NW, Suite 300, Washington, D.C., 20036, USA, which publishes more than 9,000 INCI names and references to more than 37,000 trade names and technical names, including related distributors from over 31 countries. The International Cosmetic Ingredient Dictionary and Handbook assigns to the ingredients one or more chemical classes, for example, polymer ethers, and one or more functions, such as surfactants-cleansing agents, which are further explained in detail and possibly also referred to below.

The indication CAS means that the following sequence of numbers is a name of the Chemical Abstracts Service.

In the context of the present specification, fatty acids or fatty alcohols or their derivatives are, unless stated otherwise, representative of branched or unbranched carboxylic acids or alcohols or derivatives thereof having preferably 6 to 22 carbon atoms, in particular 8 to 20 carbon atoms, particularly preferably 10 to 18 carbon atoms, most preferably 12 to 16 carbon atoms, for example, 12 to 14 carbon atoms. The former are particularly preferred due to their vegetable base as based on renewable raw materials for ecological reasons, but without limiting the present disclosure thereto. In particular, the oxo alcohols or their derivatives, which are obtainable, for example, by the ROELEN oxo synthesis preferably having 7 to 19 carbon atoms, in particular 9 to 19 carbon atoms, more preferably 9 to 17 carbon atoms, most preferably 11 to 15 carbon atoms, for example, 9 to 11, 12 to 15 or 13 to 15 carbon atoms, can also be used accordingly.

The active ingredient preparation contains, for example, one or more fragrances as perfume, preferably in an amount of from about 0.01 to about 10% by weight, in particular from about 0.05 to about 8% by weight, particularly preferably from about 0.1 to about 5% by weight. As a perfume component, d-limonene can be present. For example, the active ingredient preparation contains a perfume of essential oils (also referred to as essential oils). Pine, citrus, jasmine, patchouli, rose or ylang oil, for example, can be used as such in the context of this present disclosure. Also suitable are muscatel sage oil, chamomile oil, lavender oil, clove oil, balm oil, mint oil, cinnamon oil, lime blossom oil, juniper berry oil, vetiver oil, olibanum oil, galbanum oil and labdanum oil and orange blossom oil, neroli oil, orange peel oil and sandalwood oil.

In order to be perceptible, a fragrance must be volatile, wherein besides the nature of the functional groups and the structure of the chemical compound, the molecular weight also plays an important role. For example, most fragrances have molecular weights up to about 200 daltons, while molecular weights of about 300 daltons and above represent more of an exception. Due to the different volatility of fragrances, the odor of a perfume composed of a plurality of fragrances changes during evaporation, wherein the odor impressions are divided into top note, middle note or body and end note or dry out.

Adhesive-resistant fragrances which can be advantageously used in the active ingredient preparation in the perfume oils are, for example, the essential oils such as angelica root oil, aniseed oil, arnica blossom oil, basil oil, bay oil, champaca flower oil, fir pine oil, precious pine cone oil, elemi oil, eucalyptus oil, fennel oil, pine needle oil, galbanum oil, geranium oil, gingergrass oil, guaiac wood oil, gurdy balm oil, helichrysum oil, ho oil, ginger oil, iris oil, cajeput oil, calamus oil, chamomile oil, camphor oil, kanaga oil, cardamom oil, cassia oil, pine needle oil, copava balsam oil, coriander oil, spearmint oil, caraway oil, cumin oil, lemongrass oil, musk kernel oil, myrrh oil, clove oil, neroli oil, niaouli oil, olibanum oil, origanum oil, palmarosa oil, patchouli oil, Peru balsam oil, petitgrain oil, pepper oil, peppermint oil, pimento oil, pine oil, rose oil, rosemary oil, sandalwood oil, celery oil, star aniseed oil, thuja oil, thyme oil, verbena oil, vetiver oil, juniper berry oil, vermouth oil, wintergreen oil, ylang ylang oil, hyssop oil, cinnamon oil, cinnamon leaf oil and cypress oil.

However, the higher-boiling or solid fragrances of natural or synthetic origin can also be used advantageously in the active ingredient preparation as adherent fragrances or fragrance mixtures in the perfume oils. These compounds include the compounds listed below and mixtures thereof: Ambrettolide, α-amylcinnamaldehyde, anethole, anisaldehyde, anisalcohol, anisole, anthranilic acid methyl ester, acetophenone, benzylacetone, benzaldehyde, benzoic acid ethyl ester, benzophenone, benzyl alcohol, borneol, bornyl acetate, α-bromostyrene, n-decyl aldehyde, n-dodecyl aldehyde, eugenol, eugenol methyl ether, eucalyptol, farnesol, fenchone, fenchyl acetate, geranyl acetate, geranyl formate, heliotropin, heptincarboxylic acid methyl ester, heptaldehyde, hydroquinone dimethyl ether, hydroxycinnamaldehyde, hydroxycinnamyl alcohol, indole, iron, isoeugenol, isoeugenol methyl ether, isosafrole, jasmon, camphor, carvacrol, carvone, p-cresol methyl ether, coumarin, p-methoxy-acetophenone, methyl-n-amyl-ketone, methyl anthranilic acid methyl ester, p-methyl-acetophenone, methyl-chavikol, p-methyl-quinoline, methyl-β-naphthylketone, methyl-nononylacetaldehyde, methyl-n-nonylketone, muscone, β-naphtholethylether, β-naphthol-methylether, nerol, nitrobenzene, n-nonylaldehyde, nonyl alcohol, n-octylaldehyde, p-oxy-acetophenone, pentadecanolide, β-phenylethyl alcohol, phenylacetaldehyde-dimethylacetal, phenylacetic acid, pulegone, safrole, salicylic acid isoamyl ester, salicylic acid methyl ester, salicylic acid hexyl ester, salicylic acid cyclohexyl ester, santalol, skatole, terpineol, thymine, thymol, γ-undelactone, vaniline, veratrumaldehyde, cinnamaldehyde, cinnamyl alcohol, cinnamic acid, cinnamic acid ethyl ester, cinnamic acid benzyl ester. The lighter volatile fragrances, which are advantageously used in the perfume oil, include in particular the lower-boiling fragrances of natural or synthetic origin, which can be used alone or in mixtures. Examples of lighter volatile fragrances are alkyl isothiocyanates (alkyl mustard oils), butanedione, limonene, linalool, linayl acetate and propionate, menthol, menthone, methyl-n-heptenone, phellandrene, phenylacetaldehyde, terpinyl acetate, citral, citronellal.

The active ingredient preparation contains, for example, at least one nonionic surfactant and at least one alkylbenzenesulfonate and at least one olefinsulfonate. In addition, further surfactants can be included.

Preferred alkyl benzene sulfonates, in particular, are those having about 12 carbon atoms in the alkyl part, such as sodium linear $C_{10-13}$ alkylbenzene sulfonate. Preferred olefin sulfonates have a carbon chain length of from 14 to 16. The active ingredient preparation in this case contains preferably from about 10 to about 70% by weight, more preferably from about 20 to about 65% by weight, particularly preferably from about 20 to about 30% by weight alkylbenzenesulfonate and preferably from about 10 to about 30% by weight, more preferably from about 15 to about 30% by weight, particularly preferably from about 15 to about 25% by weight olefin sulfonate.

Nonionic surfactants can be alkoxylates such as polyglycol ethers, fatty alcohol polyglycol ethers, alkylphenol polyglycol ethers, end-capped polyglycol ethers, mixed ethers and hydroxy mixed ethers and fatty acid polyglycol esters. Also useful are ethylene oxide/propylene oxide block polymers, fatty acid alkanolamides, and fatty acid polyglycol ethers. A further important class of nonionic surfactants that can be used are the polyol surfactants, and here especially the glycated surfactants such as alkyl polyglycosides and fatty acid glucamides. Particularly preferred are the alkyl polyglycosides, in particular the alkyl polyglucosides, and especially the fatty alcohol alkoxylates (fatty alcohol polyglycol ethers).

Preferred fatty alcohol alkoxylates are alkoxylated with ethylene oxide (EO) and/or propylene oxide (PO), unbranched or branched, saturated or unsaturated $C_{8-22}$ alcohols having a degree of alkoxylation up to 30, preferably ethoxylated $C_{12-22}$ fatty alcohols having a degree of ethoxylation of less than 30, preferably from 12 to 28, in particular from 20 to 28, particularly preferably 25, for example, $C_{16-18}$ fatty alcohol having 25 EO.

Alkylpolyglycosides are surfactants which can be obtained by the reaction of sugars and alcohols according to the relevant methods of preparative organic chemistry, wherein, depending on the nature of the preparation, a mixture of monoalkylated, oligomeric or polymeric sugars is obtained. Preferred alkyl polyglycosides are the alkyl polyglucosides, wherein the alcohol particularly preferably is a long-chain fatty alcohol or a mixture of long-chain fatty alcohols having branched or unbranched $C_8$ to $C_{18}$ alkyl chains and the degree of oligomerization (DP) of the sugars between 1 and 10, preferably from 1 to 6, in particular from 1.1 to 3, more preferably from 1.1 to 1.7, for example, $C_{8-10}$ alkyl-1.5-glucoside (DP of 1.5).

Preferably, fatty alcohol ethoxylates are used in amounts of up to about 20% by weight, more preferably from about 4 to about 12% by weight, particularly preferably from about 7 to about 9% by weight. In addition, further nonionic surfactants, for example, fatty acid monoalkanolamides and/or alkylpolyglycosides, can be present in amounts of up to about 10% by weight.

Further anionic surfactants which can be used in the active compound preparations are aliphatic sulfates, such as fatty alcohol sulfates, fatty alcohol ether sulfates, dialkyl ether sulfates, monoglyceride sulfates and aliphatic sulfonates, such as alkanesulfonates, ether sulfonates, n-alkyl ether sulfonates, ester sulfonates and lignosulfonates. Also usable are fatty acid cyanamides, sulfosuccinates (sulfosuccinic esters), in particular sulfosuccinic acid mono- and di-$C_8$-$C_{18}$ alkyl esters, sulfosuccinamates, sulfosuccinamides, fatty acid isethionates, acylaminoalkanesulfonates (fatty acid taurides), fatty acid sarcosinates, ethercarboxylic acids and alkyl (ether) phosphates and α-sulfofatty acid salts, acylglutamates, monoglyceride disulfates and alkyl ethers of glycerol disulfate.

Preferred in the context of the present disclosure are the fatty alcohol sulfates and/or fatty alcohol ether sulfates, in particular the fatty alcohol sulfates. Fatty alcohol sulfates are products of sulfation reactions on corresponding alcohols, while fatty alcohol ether sulfates are products of sulfation reactions on alkoxylated alcohols. The person skilled in the art generally understands alkoxylated alcohols as meaning the reaction products of alkylene oxide, preferably ethylene oxide, with alcohols, in the context of the present disclosure preferably with longer-chain alcohols. As a rule, a complex mixture of addition products of different degrees of ethoxylation is formed from n moles of ethylene oxide and one mole of alcohol, as a function of the reaction conditions. A further embodiment of the alkoxylation is the use of mixtures of the alkylene oxides, preferably the mixture of ethylene oxide and propylene oxide. Preferred fatty alcohol ether sulfates are the sulfates of low ethoxylated fatty alcohols having from 1 to 4 ethylene oxide units (EO), in particular from 1 to 2 EO, for example, 1.3 EO.

The anionic surfactants are preferably used as sodium salts, but can also be present as other alkali metal or alkaline earth metal salts, for example, magnesium salts, and in the form of ammonium or mono-, di-, tri- or tetra-alkylammonium salts, in the case of the sulfonates, also in the form of their corresponding acid, for example, dodecylbenzenesulfonic acid.

In addition to the previously mentioned types of surfactant, the agent as contemplated herein can further contain cationic surfactants and/or amphoteric surfactants. Suitable amphoteric surfactants are, for example, betaines of the formula $(R^{ii})(R^{iv})(R^{v})N^{+}CH_2COO^{-}$, in which $R^{iii}$ is an alkyl radical optionally interrupted by hetero atoms or heteroatom groups having from 8 to 25, preferably from 10 to 21 carbon atoms and $R^{iv}$ and $R^{v}$ are identical or different alkyl radicals having from 1 to 3 carbon atoms, in particular $C_{10}$-$C_{18}$ alkyldimethylcarboxymethylbetain and $C_{11}$-$C_{17}$ alkylamidopropyl-dimethylcarboxymethylbetain.

Suitable cationic surfactants are the quaternary ammonium compounds of the formula $(R^{vi})(R^{vii})(R^{viii})(R^{ix})N^{+}X^{-}$, in which $R^{vi}$ to $R^{ix}$ stand for four identical or different, in particular two long- and two short-chain, alkyl radicals and $X^{-}$ stands for an anion, in particular a halide ion, for example, didecyl-dimethyl-ammonium chloride, alkyl-benzyl-didecyl-ammonium chloride and mixtures thereof.

In addition to the ingredients mentioned so far, the active ingredient preparation can contain further ingredients commonly used in active ingredient preparations for toilet blocks and cleaning agents for cleaning a toilet bowl, preferably selected from the group comprising acids, bases, salts, thickening agents, antimicrobial active agents, preservatives, complexing agents, polymers, dyes, perfumes, perfume boosters, fillers, builders, bleaching agents, corrosion inhibitors, rinse-off regulators, enzymes, microorganisms, biofilm removal agents, limescale inhibiting agents, soiling adhesion reducing agents, processability improving agents, tack reducing agents, and mixtures thereof. Overall, not more than 60% by weight of further ingredients should be included, preferably from about 0.01 to about 60% by weight, in particular from about 0.2 to about 15% by weight.

According to a second aspect of the present disclosure, a method is disclosed which comprises:

obtaining a control information item on a device, wherein the control information item is at least partially a function of a first environmental parameter detected by a sensor of a sensor device in an environment of the sensor device, and wherein the first environmental parameter is characteristic of a cleanliness of a toilet bowl; and outputting and/or effecting the outputting of a user information item by the device, wherein the user information item is at least partially a function of the obtained control information item.

Furthermore, according to the second aspect of the present disclosure, a device, in particular a user device, is disclosed, set up for executing and/or controlling the steps of the method according to the second aspect of the present disclosure or comprising respective features for executing and/or controlling the steps of the method according to the second aspect of the present disclosure. In this case, either all steps of the method according to the second aspect of the present disclosure can be controlled by the features, or all steps of the method according to the second aspect of the present disclosure can be executed by the features, or one or more steps are controlled by the features and one or more steps are executed by the features. Different steps can optionally be executed or controlled by different features.

In this case, the features of the device according to the second aspect of the present disclosure, as disclosed above for the features of the sensor device according to the first aspect of the present disclosure, can comprise hardware and/or software components. Accordingly, according to the second aspect of the present disclosure, a sensor device as disclosed is also to be understood as comprising at least one processor and at least one memory with program instructions, wherein the at least one memory and the program instructions are set up, together with the at least one processor, to cause the output device to execute and/or control the method according to the second aspect of the present disclosure.

Alternatively or additionally, the features of the device according to the second aspect of the present disclosure can comprise one or more communication interfaces and/or one or more user interfaces.

It is understood that the sensor device according to the second aspect of the present disclosure can also comprise other features not mentioned.

Furthermore, according to the second aspect of the present disclosure, there is disclosed a computer program comprising program instructions configured to cause a device (for example, the device according to the second aspect of the present disclosure) to execute and/or control the method according to the second aspect of the present disclosure when the computer program is executed by a processor of the device (for example, the device according to the second aspect of the present disclosure).

Furthermore, according to the second aspect of the present disclosure, there is disclosed a computer-readable storage medium containing a computer program according to the second aspect of the present disclosure.

In the following, the features and characteristics of the second aspect of the present disclosure are described, partly by way of example.

For example, the control information item is a control information item determined by a sensor device according to the first aspect of the present disclosure. Accordingly, the disclosure of the at least partially exemplary features and characteristics of the control information item in connection with the first aspect of the present disclosure should also be deemed to be disclosed in connection with the second aspect of the present disclosure.

Obtaining a control information item at the device is to be understood as meaning, for example, that the control information item is received by a communication interface (for example, a wireless communication interface) of the device. For example, the control information item is received by a communication interface (for example, a wireless communication interface) of the device from a sensor device according to the first aspect of the present disclosure. The control information item can be received, for example, in the form of a broadcast signal (for example, a beacon signal such as a Bluetooth beacon signal). Accordingly, the wireless communication interface of the device can be a Bluetooth interface.

Alternatively or additionally, obtaining a control information item at the device can, for example, also be understood as meaning that a control information item provided by a sensor device according to the first aspect of the present disclosure is read through a communication interface (for example, a wireless communication interface) of the device. As disclosed above, the control information item can be provided by a passive wireless communication interface for reading by a corresponding active wireless communication interface. Accordingly, the wireless communication interface of the device can be such a corresponding active wireless communication interface. Examples of such active wireless communication interfaces are active electronic transceivers such as active RFID interfaces (for example, RFID readers) and/or active NFC interfaces (for example, NFC readers).

For example, the outputting of the user information item is triggered by the control information item. For example, as disclosed above in connection with the first aspect of the present disclosure, the control information item is determined by the sensor device according to the first aspect of the present disclosure to trigger the outputting of a user information item (for example, the first user information item disclosed above and/or the second user information item disclosed above) according to the present second aspect of the present disclosure. In this case, according to the present second aspect of the present disclosure, the same user information items as in the first aspect of the present disclosure can be output, so that the corresponding disclosure in connection with the first aspect of the present disclosure should also be regarded as disclosure in connection with the second aspect of the present disclosure.

The outputting of the user information item can be done for example, by a user interface. For example, the user information item is output by a user interface of the device (for example, the device according to the second aspect of the present disclosure), for example, an optical user interface, in particular a display. A display, as disclosed above, is to be understood as meaning, for example, a signal lamp and/or a signal lamp arrangement having multiple signal lamps. Accordingly, the user could be notified, for example, by a signal lamp (for example, by a multi-colored signal lamp) and/or by a signal lamp arrangement (for example, by a signal lamp arrangement having different colored signal lamps), whether the toilet bowl is clean. Furthermore, a display is also to be understood as meaning a screen, so that the user can be notified on the screen by outputting an appropriate user information item (for example, in text form) as to whether the toilet bowl is clean.

The device (for example, the device according to the second aspect of the present disclosure) is for example, a user device and/or part of a user device. In this case, a user device is understood as meaning a portable and/or mobile device of a user, such as a smartphone, a tablet computer, a laptop computer, a handheld reader (for example, an RFID and/or NFC handheld reader), and the like. This is advantageous, for example, in order to be able to display user information items on the cleanliness of a toilet bowl for a user on his user devices. As a result, a user can, for example, be directed to a toilet having a clean toilet bowl. Furthermore, a user (for example, a user responsible for cleaning a toilet) can be prompted to clean a toilet having a non-clean (for example, soiled and/or calcified) toilet bowl. Also, the cleanliness of a toilet bowl can be checked by a user (for example, a user responsible for cleaning a toilet).

Alternatively, however, the device (for example, the device according to the second aspect of the present disclosure) can also be a server device and/or a server system (for example, a server cloud). This is advantageous, for example, to allow remote monitoring of the cleanliness of one or more toilet bowls, for example, to ensure the monitoring of hygiene regulations.

According to a third aspect of the present disclosure, there is disclosed a method comprising the steps of the method according to the first aspect of the present disclosure and the steps of the method according to the second aspect of the present disclosure.

Furthermore, according to the third aspect of the present disclosure, there is disclosed a system comprising a server device according to the first aspect of the present disclosure and a device, in particular a user device, according to the second aspect of the present disclosure.

The above-disclosed individual embodiments and designs according to the aspects of the present disclosure and the individual features and properties of these embodiments and designs are also to be understood as disclosed in all technically meaningful combinations.

Furthermore, the embodiments and designs described above are to be understood as merely exemplary in nature and are not intended to limit the present disclosure in any way.

Further advantageous exemplary embodiments of the present disclosure can be found in the following detailed description of some exemplary embodiments of the present disclosure, in particular in conjunction with the figures. However, the figures should only serve the purpose of clarification, but not to determine the scope of the present disclosure. The figures are not to scale and are merely intended to reflect the general concept of the present disclosure. In particular, features included in the figures should by no means be considered as a necessary part of the present disclosure.

BRIEF DESCRIPTION OF THE DRAWINGS

The present disclosure will hereinafter be described in conjunction with the following drawing figures, wherein like numerals denote like elements, and.

DETAILED DESCRIPTION

The following detailed description is merely exemplary in nature and is not intended to limit the disclosure or the application and uses of the subject matter as described herein. Furthermore, there is no intention to be bound by any theory presented in the preceding background or the following detailed description.

Figure 1A:
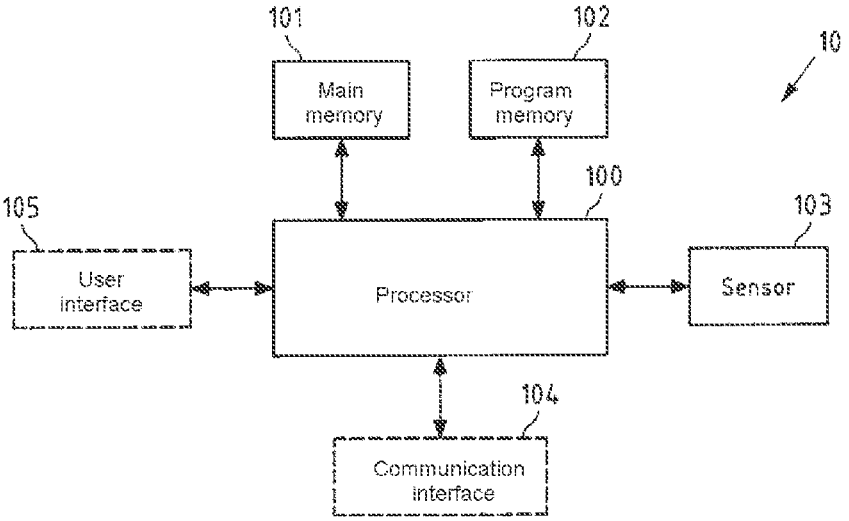
FIG. 1*a* is a block diagram of an exemplary embodiment of a sensor device according to the first aspect of the present disclosure.

FIG. 1*a* shows a block diagram of an exemplary embodiment of a sensor device 10 according to the first aspect of the present disclosure. Sensor device 10 comprises at least a processor 100, a main memory 101, a program memory 102, a sensor 103, an optional communication interface 104 and an optional user interface 105.

A processor is to be understood as meaning, for example, a control unit, a microprocessor, a microcontroller such as a microcontroller, a digital signal processor (DSP), an application specific integrated circuit (ASICs) or a field programmable gate array (FPGAs). It is understood that sensor device 10 can also comprise a plurality of processors 100.

Processor 100 executes program instructions stored in program memory 102, and stores, for example, intermediate results or the like in main memory 101. The program memory 102 contains, for example, program instructions of a computer program according to the first aspect of the present disclosure, comprising program instructions that cause the processor 100 to execute or control the method according to the first aspect of the present disclosure (for example, the method according to the flowchart 400 shown in FIG. 4) when the processor 100 executes these program instructions stored in program memory 102. In addition, further information items such as determination rules for determining a control information item can be stored in program memory 102.

Program memory 102 also contains, for example, the operating system of sensor device 10, which is loaded at least partially into main memory 101 when the sensor device 10 is started and executed by processor 100. In particular, when the sensor device 10 is started, at least part of the kernel of the operating system is loaded into the main memory 101 and executed by processor 100.

An example of an operating system is a Windows, UNIX, Linux, Android, Apple iOS, and/or MAC OS operating system. In particular, the operating system enables the use of the data processing device. It manages, for example, resources such as a main memory and a program memory, provides, among other things, other computer programs basic functions through programming interfaces and controls the execution of computer programs.

A program memory is, for example, a non-volatile memory such as a flash memory, a magnetic memory, an EEPROM memory (electrically erasable programmable read-only memory) and/or an optical memory. A main memory is for example, a volatile or non-volatile memory, in particular a random access memory (RAM) such as a static RAM memory (SRAM), a dynamic RAM memory (DRAM), a ferroelectric RAM memory (FeRAM) and/or a magnetic RAM memory (MRAM).

Main memory 101 and program memory 102 can also be configured as a memory. Alternatively, main memory 101 and/or program memory 102 can each be formed by a plurality of memories. Furthermore, main memory 101 and/or program memory 102 can also be part of the processor 100.

Furthermore, processor 100 can control at least one sensor 103. The sensor 103 is set up, for example, to detect an environmental parameter characteristic of a cleanliness of a toilet bowl. For example, as disclosed above, an environmental parameter characteristic of soiling and/or calcification of the surface of the toilet bowl (and thus of a cleanliness of a toilet bowl) is a value for the intensity of light reflected from the surface of the toilet bowl in the direction of a reflection sensor (for example, a light generated by the reflection sensor) and/or a change in the intensity of a light reflected from the surface of the toilet bowl in the direction of a reflection sensor (for example, a light generated by the reflection sensor). Further environment parameters characteristic of cleanliness of the toilet bowl disclosed above are, for example, a turbidity value detected by a turbidity sensor of a liquid located in the toilet bowl and/or a bacterial content detected by a biosensor on the surface of the toilet bowl and/or in a liquid in the toilet bowl. It is understood that the present disclosure is not limited to these sensors and/or environmental parameters.

In the following, it is assumed by way of example that the sensor 103 is a reflection sensor which is set up to detect a value for the intensity of a light reflected from the surface of the toilet bowl in the direction of the reflection sensor (for example, a light generated by the reflection sensor) and/or a change in intensity of light reflected from the surface of the toilet bowl in the direction of a reflection sensor (for example, a light generated by the reflection sensor).

Furthermore, processor 100 controls the optional wireless communication interface 104. The wireless communication interface 104 is set up, for example, for sending information items (for example, in the form of a broadcast signal). Alternatively or additionally, the wireless communication interface is set up, for example, as a passive wireless communication interface providing information items for reading by a corresponding active wireless communication interface. Furthermore, the wireless communication interface 104 is set up, for example, to receive information items. The wireless communication interface 104 is, for example, a Bluetooth interface, an (for example, passive) NFC interface and/or an (for example, passive) RFID interface.

In addition, processor 100 can control optional user interface 105, for example, by a control information item in the form of a control signal. The optional user interface is set up, for example, to output user information items. Examples of such a user interface are a display such as a screen (for example, a touch-sensitive screen) and/or a signal lamp (for example, a light emitting diode and/or a light bulb and/or a glow lamp) and/or a signal lamp arrangement having a plurality of signal lamps. In the following, it is assumed by way of example that the user interface 105 is formed as a signal lamp arrangement having a plurality of signal lamps. For example, the signal lamp arrangement has at least a first signal lamp for indicating that the toilet bowl is clean, and a second signal lamp for indicating that the toilet bowl is not clean.

The components 100 to 105 of the sensor device are communicatively connected to each another, for example, via one or more bus systems (for example, one or more serial and/or parallel bus connections).

It is understood that the sensor device, in addition to the components 100 to 105, can comprise further components (for example, further sensors).

Figure 1B:
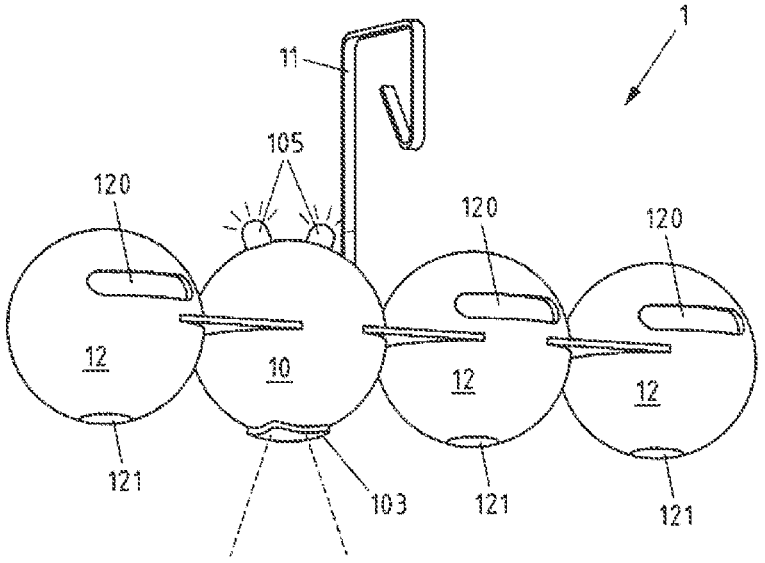
FIG. 1*b* is a schematic representation of an exemplary embodiment of a dispensing device having a sensor device according to the first aspect of the present disclosure.

FIG. 1*b* shows a schematic representation of an exemplary embodiment of a dispensing device 1 having the sensor device 10 according to the first aspect of the present disclosure. The user interface 105 is shown in FIG. 1*b* as a signal lamp arrangement having two signal lamps. Furthermore, the sensor 103 is shown by example in FIG. 1*b*.

In addition to the sensor device 10, the dispensing device 1 comprises a bow-shaped holding element 11 which is fixable to an edge of a toilet bowl, and one or more open receptacles 12 for receiving in each case a spherical toilet block having a diameter of from about 25 to about 40 mm. The receptacles 12 have one or more flushing liquid inlet and outlet openings 120 and 121 through which flushing liquid can flow past a toilet block accommodated in the respective receptacle 12.

When the holding element 12 is fixed to an edge of a toilet bowl, the sensor device 10 and the receptacle 12 are located at an end of the dispensing device 1 arranged in the interior of the toilet bowl.

Figure 2:
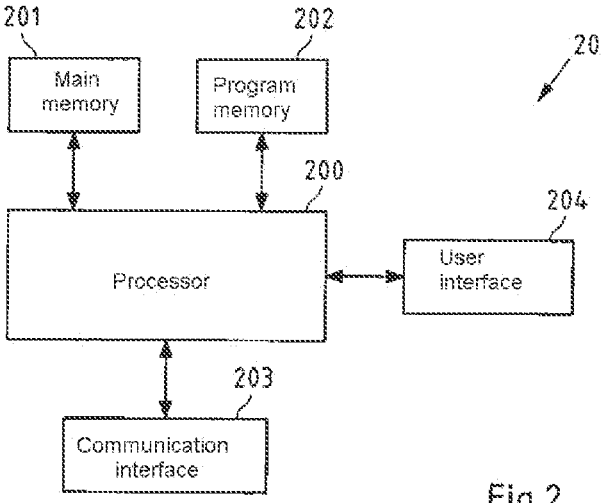
FIG. 2 is a block diagram of an exemplary embodiment of a device according to the second aspect of the present disclosure.

FIG. 2 shows a block diagram of a device 20 according to the second aspect of the present disclosure.

Device 20 comprises at least a processor 200, a main memory 201, a program memory 202, a communication interface 203 and a user interface 204.

It is understood that device 20 can also comprise a plurality of processors 200.

Processor 200 executes program instructions stored in program memory 202, and stores, for example, intermediate results or the like in main memory 201. The program memory 202 contains, for example, program instructions of a computer program according to the second aspect of the present disclosure, comprising program instructions that cause the processor 200 to execute or control the method according to the second aspect of the present disclosure (for example, the method according to the flowchart 500 shown in FIG. 5) when the processor 200 executes these program instructions stored in program memory 202.

Program memory 202 also contains, for example, the operating system of device 20, which is loaded at least partially into main memory 201 when the device 20 is started and executed by processor 200.

Main memory 201 and program memory 202 can also be configured as a memory. Alternatively, main memory 201 and/or program memory 202 can each be formed by a plurality of memories. Furthermore, main memory 201 and/or program memory 202 can also be part of the processor 200.

Processor 200 controls the wireless communication interface 203, which is formed, for example, as a wireless communication interface corresponding to the wireless communication interface 104 of the sensor device 10. For example, the wireless communication interface 203 is configured as a Bluetooth interface, an (for example, active) NFC interface and/or an (for example, active) RFID interface. The communication interface 203 is in particular set up to receive an information item and/or to read an information item provided by a passive wireless communication interface.

Furthermore, processor 200 can control at least one user interface 204. Such a user interface can comprise, for example, one or more keys, a keyboard (for example, an alphanumeric keyboard or a numeric keyboard such as a keypad), a mouse, a screen (for example, a touch-sensitive screen such as a touch display), a microphone, and/or a camera. The user interface 204 can be used for communication with a user, for example, for inputting and/or outputting user information items. For example, the user interface 204 is the standard user interface of device 20.

The components 200 to 204 of the sensor device are communicatively connected to each another, for example, via one or more bus systems (for example, one or more serial and/or parallel bus connections).

It is understood that the device 20 can include further components in addition to the components 200 to 204.

Figure 3:
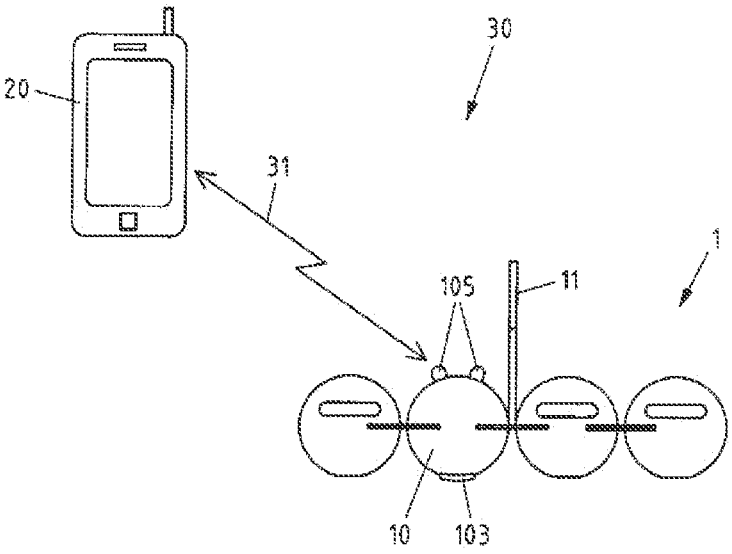
FIG. 3 is a schematic representation of an exemplary embodiment of a system according to the third aspect of the present disclosure.

FIG. 3 shows a schematic representation of an exemplary embodiment of a system 30 according to the third aspect of the present disclosure; The system 30 comprises the sensor device 10 and the device 20. In FIG. 3, the sensor device 10 is exemplified as part of the dispensing device 1 and the device 20 is exemplified as a smartphone.

A wireless communication path 31 is shown in FIG. 3 between the sensor device 10 and the device 20. Via this communication path 31, the device 20 can receive information items sent by the device 10 (for example, information items sent in the form of a broadcast signal) and/or read information items provided by the device 10. The communication (for example, the sending/providing and/or receiving/reading of information items) via the communication path 31 can take place, for example, through the communication interfaces 104 and 203 of the sensor device 10 and the device 20.

Figure 4:
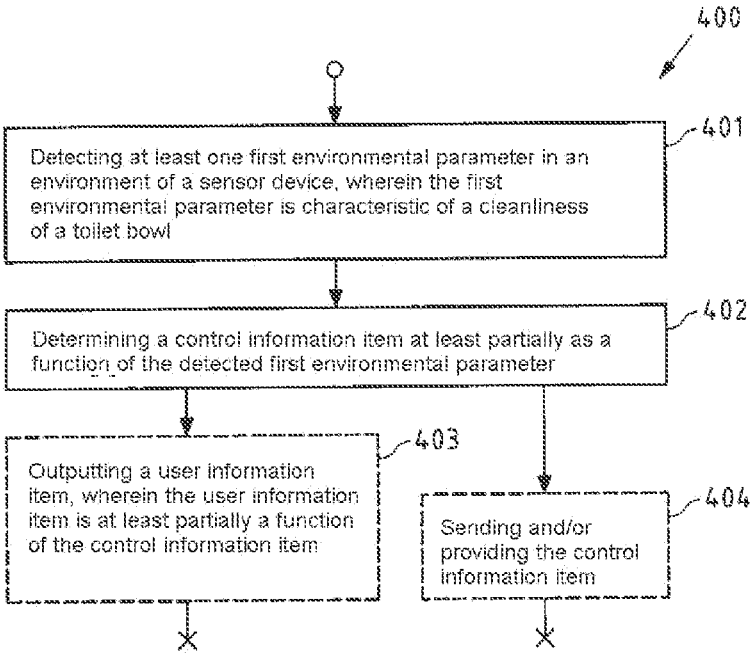
FIG. 4 is a flowchart of an exemplary embodiment of a method according to the first aspect of the present disclosure.

FIG. 4 shows a flowchart 400 of an exemplary embodiment of a method according to the first aspect of the present disclosure. In the following, it is assumed by way of example that the steps 401 to 404 of the flowchart 400 are executed by the sensor device 10 in the system 30 when the sensor device 10 (for example, as part of the dispensing device 1) is arranged in the interior of a toilet bowl.

In a step 401, a first environmental parameter in the environment of the sensor device 10 is detected by the sensor 103. In this case, the first environmental parameter is characteristic of a cleanliness of the toilet bowl in which the sensor device 10 is arranged.

As disclosed above, sensor 103 is a reflection sensor and the environmental parameter detected by sensor 103 is a value for the intensity of light reflected from the surface of the toilet bowl in the direction of the reflection sensor (for example, a light generated by the reflection sensor) or a change in the intensity of a light reflected from the surface of the toilet bowl in the direction of a reflection sensor (for example, a light generated by the reflection sensor).

In a step 402, a control information item is determined at least partially as a function of the first environmental parameter detected in step 401.

The control information item is set up, for example, to trigger and/or control an action that can be executed by the sensor device and/or by a device other than the sensor device (for example, outputting a user information item and/or outputting an active ingredient preparation). For example, the control information item is a control signal that triggers and/or controls the output of a user information item by the user interface 105 of the sensor device 10. Alternatively or additionally, for example, the control information item can trigger and/or control the outputting of a user information item by the user interface 204 of the device 20 when the control information item is obtained at the device 20.

The determination can be performed, for example, according to specified determination rules (for example, selection and/or calculation rules). For example, as disclosed above, the determination rules can specify that when the first environmental parameter indicates that the toilet bowl is clean, a first control information item is determined that triggers first a user information item indicating to the user that the toilet bowl is clean. Otherwise, the determination rules specify, for example, that a second control information item is determined, which triggers the outputting of a second user information item that indicates to a user that the toilet bowl is not clean. Alternatively or additionally, the second user information item can indicate to the user that the toilet bowl should be cleaned and/or give the user a cleaning recommendation to clean the toilet bowl.

For example, the determination rules can specify a threshold for the intensity of light reflected from the surface of the toilet bowl in the direction of a reflection sensor. When the first environmental parameter is indicative of an intensity of a light reflected from the surface of the toilet bowl in the direction of the reflection sensor, which does not fall below this threshold value, it is, for example, specified that the first control information item is to be determined. Otherwise, for example, it is specified that the second control information item should be determined. Alternatively or additionally, the determination rules can specify a threshold value for a change in the intensity of a light reflected from the surface of the toilet bowl in the direction of a reflection sensor (for example, a light generated by the reflection sensor). When the first environmental parameter is indicative of a change in an intensity of a light reflected from the surface of the toilet bowl in the direction of the reflection sensor, which does not exceed this threshold value, it is, for example, specified that the first user information item is to be determined. Otherwise, for example, it is specified that the second user information item should be determined.

Subsequently, the optional steps 403 and 404 can be executed. It should be understood that one of steps 403 and 404, both steps 403 and 404 or none of steps 403 and 404 may be executed.

In the optional step 403, a user information item is output by the user interface 105 of the sensor device 10. In this case, the user information item is at least partially a function of the control information item determined in step 402. For example, the user interface 105 is controlled by the control information item determined in step 402 such that when a user is to be notified that the toilet bowl is clean, a first signal lamp (for example, a green signal lamp) of the user interface 105 lights up and, when a user is to be notified, indicates that the toilet bowl is not clean, a second signal lamp (for example, a red signal lamp) of the user interface 105 lights up.

In optional step 404, the control information item determined in step 402 is sent by the wireless communication interface 104 of the sensor device 10 (for example, in the form of a broadcast signal) and/or provided (for example, for reading by the wireless communication interface 203 of the device 20). This is used, for example, to effect a user information item to be output by a device (for example, device 20) other than the sensor device when the control information item is obtained at this device (for example, device 20).

Figure 5:
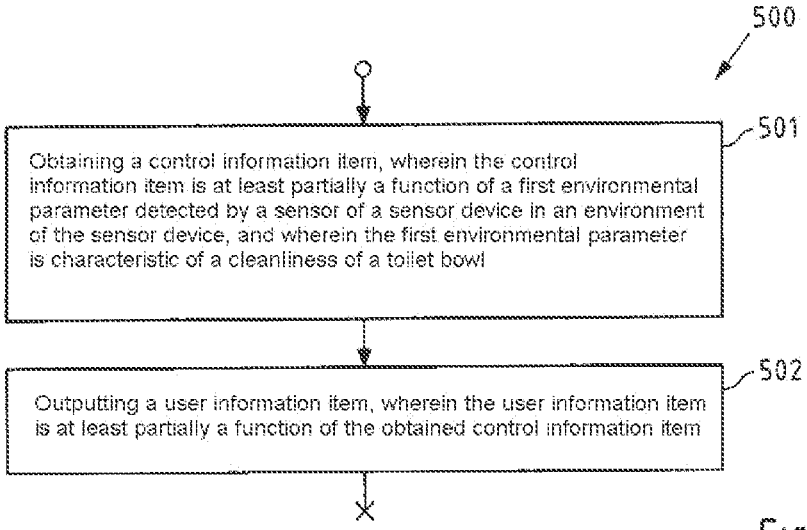
FIG. 5 is a flowchart of an exemplary embodiment of a method according to the second aspect of the present disclosure.

FIG. 5 shows a flowchart 500 of an exemplary embodiment of a method according to the second aspect of the present disclosure. In the following, it is assumed by way of example that the steps 501 to 502 of the flowchart 500 are executed by the device 20 in the system 30.

In a step 501, control information item is obtained at the device 20. These are, for example, the control information item sent and/or provided by the wireless communication interface 104 of the sensor device 10 in step 404. For example, the control information item is received and/or read by the wireless communication interface 203 of the device 20 in step 501.

In a step 502, a user information item is output by the user interface 204 of the device 20. In this case, the user information item is at least partially a function of the control information item determined in step 501.

As disclosed above, for example, the control information item can trigger and/or control the outputting of a user information item by the user interface 204 of the device 20 when the control information item is obtained at the device 20. For example, in this case, the user information item can indicate to the user whether the toilet bowl is clean. The user information item can take place, for example, in the form of a corresponding text display on a user interface 204 of the device 20 formed as a screen.

Figure 6:
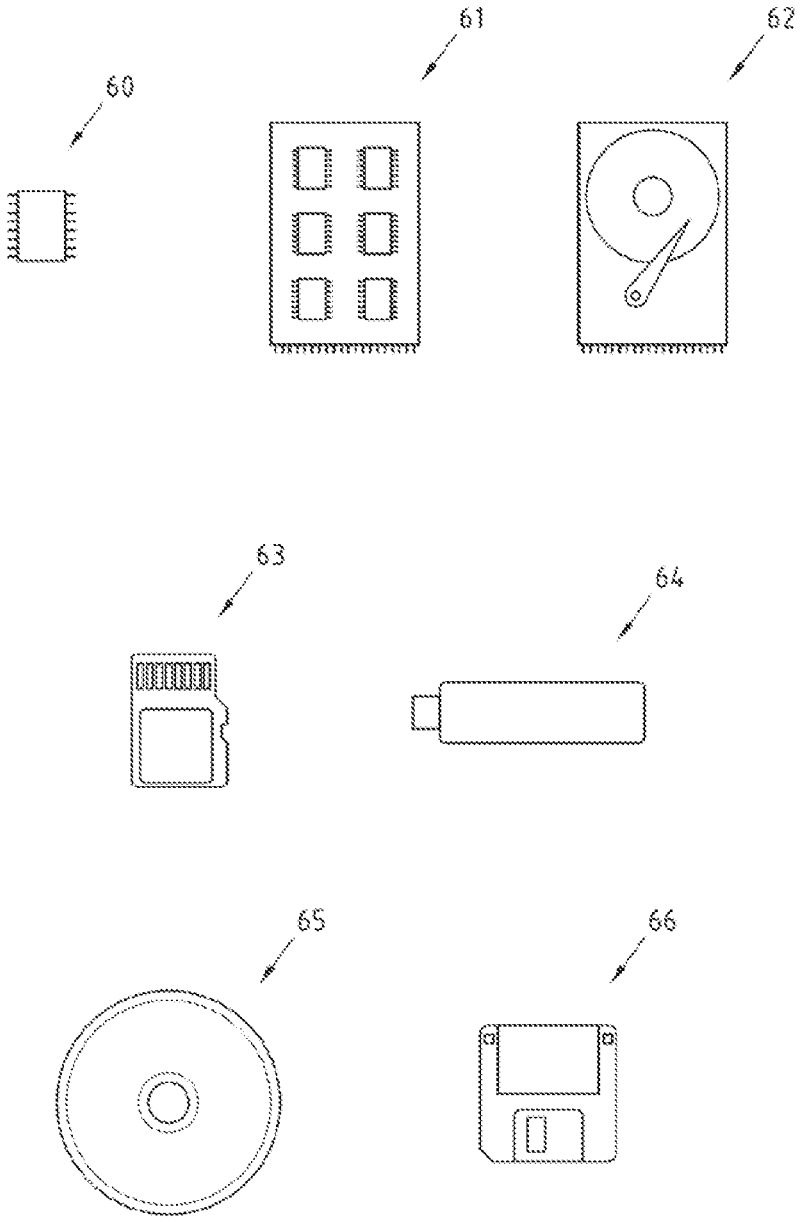
FIG. 6 shows different exemplary embodiments of a storage medium.

FIG. 6 shows different embodiments of storage media on which an embodiment of a computer program as contemplated herein can be stored. The storage medium can be, for example, a magnetic, electrical, optical and/or different storage medium. The storage medium can, for example, be part of a processor (for example, the processor 100 of the sensor device 10 and/or the processor 200 of the device 20), for example, a (non-volatile or volatile) program memory of the processor or a part thereof (such as program memory 102 of the sensor device 10 and/or program memory 202 of device 20). Embodiments of a storage medium are a flash memory 60, an SSD hard disk 61, a magnetic hard disk 62, a memory card 63, a memory stick 64 (for example, a USB stick), a CD-ROM or DVD 65, or a diskette 66.

The embodiments of the present disclosure described in this specification and the respective listed optional features and properties in this regard are to be understood as being disclosed in all combinations with one another. In particular, the description of a feature encompassed by an embodiment—unless explicitly explained to the contrary—should not be understood in the present case as meaning that the feature is necessary or essential for the function of the embodiment. The sequence of the method steps described in this specification is not mandatory, alternative sequences of the method steps are conceivable. The method steps can be implemented in various ways, so an implementation in software (by program instructions), hardware, or a combination of both to implement the method steps is conceivable.

Terms used in the claims, such as "comprising," "having," "including," "containing," and the like, do not exclude further elements or steps. The phrase "at least partially" includes both the "partial" and "full" cases. The expression "and/or" is to be understood as meaning that both the alternative and the combination are to be disclosed, that is, "A and/or B" means "(A) or (B) or (A and B)". The use of the indefinite article does not exclude a plurality. A single device can perform the functions of several units or devices mentioned in the claims. Reference signs indicated in the patent claims should not be regarded as limitations on the features and steps employed.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the various embodiments in any way. Rather, the foregoing detailed description will provide those skilled in the art with a convenient road map for implementing an exemplary embodiment as contemplated herein. It being understood that various changes may be made in the function and arrangement of elements described in an exemplary embodiment without departing from the scope of the various embodiments as set forth in the appended claims.

The invention claimed is:

1. A method executed by a sensor device arranged in and/or on a toilet bowl, the method comprising the steps of:

detecting, by a sensor of the sensor device, at least a first environmental parameter in an environment of the sensor device, the first environmental parameter being characteristic of a cleanliness of the toilet bowl; and determining and/or effecting a determination of a control information item by the sensor device at least partially as a function of the detected first environmental parameter, wherein the at least one sensor is a biosensor and the first environmental parameter detected by the biosensor is indicative of:

a bacterial content on a surface of the toilet bowl, and/or a bacterial content of a liquid located in the toilet bowl.

2. The method according to claim 1, wherein the at least one sensor is an optical sensor and the first environmental parameter detected by the optical sensor is indicative of:

a surface roughness of a surface of the toilet bowl, a wettability and/or a change in the wettability of a surface of the toilet bowl, an optical reflection on a surface of the toilet bowl, and/or a turbidity of a liquid located in the toilet bowl.

3. The method according to claim 1, further comprising:

outputting and/or effecting the outputting of a user information item, wherein the user information item is at least partially a function of the control information item.

4. The method according to claim 3, wherein the user information item is output by a user interface of the sensor device and the user interface is an optical user interface.

5. The method according to claim 4, wherein the user interface is a display.

6. The method according to claim 1, the method further comprising:

sending and/or providing the control information item by a wireless communication interface of the sensor device.

7. The method according to claim 1, wherein the sensor device is part of a dispensing device and the method further comprises:

outputting and/or effecting the outputting of an active ingredient preparation by the dispensing device at least partially as a function of the control information item.

8. The method according to claim 7, wherein the dispensing device comprises a control unit, a container for receiving the active ingredient preparation and at least one actuator, wherein the control information item is set up to trigger and/or control a movement of the actuator, and wherein the movement of the actuator effects the outputting of the active ingredient preparation.

9. The method according to claim 7, wherein the dispensing device has a bow-shaped holding element fixable to an edge of the toilet bowl and when the holding element is fixed to the edge of the toilet bowl, the dispensing device comprises a distal end located in the interior of the toilet bowl and the sensor device is arranged at the distal end.

10. A sensor device arranged to execute and/or control the method according to claim 1.

11. The sensor device according to claim 10, wherein the sensor device is part of a dispensing device and/or is not part of the toilet bowl.

12. A computer program comprising program instructions configured to cause a device for executing and/or controlling the method according to claim 1 when the computer program is executed by a processor.

13. A method comprising the steps of:

obtaining a control information item on a device, wherein the control information item is at least partially a function of a first environmental parameter detected by a sensor of a sensor device in an environment of the sensor device, and wherein the first environmental parameter is characteristic of a cleanliness of a toilet bowl; and outputting and/or effecting the outputting of a user information item by the device, wherein the user information item is at least partially a function of the obtained control information item, wherein the at least one sensor is a biosensor and the first environmental parameter detected by the biosensor is indicative of:

a bacterial content on a surface of the toilet bowl, and/or a bacterial content of a liquid located in the toilet bowl.

14. A device set up for executing and/or controlling the method according to claim 13.

15. A computer program comprising program instructions configured to cause a device for executing and/or controlling the method according to claim 13 when the computer program is executed by a processor.

16. A system, comprising:

a toilet including a toilet bowl;

a dispensing device fixed to the toilet bowl and having a distal end and a sensor device at the distal end with the sensor device having a processor configured to execute a computer program causing the processor to:

detect at least a first environmental parameter in an environment of the sensor device with the first environmental parameter being characteristic of a cleanliness of the toilet bowl, and determining and/or effecting a determination of a control information item at least partially as a function of the detected first environmental parameter; and a user device in communication with the sensor device and having a processor configured to execute a computer program causing the processor to:

obtain the control information item, and output and/or effect the outputting of a user information item at least partially a function of the obtained control information item, wherein the at least one sensor is a biosensor and the first environmental parameter detected by the biosensor is indicative of:

a bacterial content on a surface of the toilet bowl, and/or a bacterial content of a liquid located in the toilet bowl.

* * * * *